US011568811B2

(12) United States Patent
Kim et al.

(10) Patent No.: US 11,568,811 B2
(45) Date of Patent: Jan. 31, 2023

(54) ELECTROLUMINESCENCE DISPLAY APPARATUS

(71) Applicant: LG DISPLAY CO., LTD., Seoul (KR)

(72) Inventors: Beom Jin Kim, Seoul (KR); Bong Choon Kwak, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/354,353

(22) Filed: Jun. 22, 2021

(65) Prior Publication Data

US 2021/0398489 A1 Dec. 23, 2021

(30) Foreign Application Priority Data

Jun. 22, 2020 (KR) ..... 10-2020-0075693

(51) Int. Cl.
*G09G 3/3233* (2016.01)
*G09G 3/3258* (2016.01)
*G09G 3/325* (2016.01)

(52) U.S. Cl.
CPC ..... *G09G 3/3233* (2013.01); *G09G 3/325* (2013.01); *G09G 3/3258* (2013.01); *G09G 2300/0439* (2013.01); *G09G 2300/0852* (2013.01); *G09G 2310/08* (2013.01); *G09G 2320/0233* (2013.01); *G09G 2320/041* (2013.01)

(58) Field of Classification Search
CPC ..... G09G 2300/0439; G09G 3/3233; G09G 2300/0852; G09G 2310/08; G09G 2320/0233; G09G 2320/041
See application file for complete search history.

(56) References Cited

U.S. PATENT DOCUMENTS 7,329,849 B2 * 2/2008 Kasai ..... G09G 3/3233 250/214 R
8,378,930 B2 * 2/2013 Asano ..... H01L 27/124 345/82
8,379,062 B2 * 2/2013 Kubota ..... G09G 3/3233 345/55
8,610,648 B2 * 12/2013 Goh ..... G09G 3/3233 345/82
9,125,249 B2 * 9/2015 Kim ..... G09G 3/3233
9,299,290 B2 * 3/2016 Ono ..... G09G 3/3258
9,412,295 B2 * 8/2016 Okuno ..... G09G 3/3233
(Continued)

FOREIGN PATENT DOCUMENTS

JP 2012098707 A 5/2012
JP 2014522506 A 9/2014
WO 2006103802 A1 10/2006

OTHER PUBLICATIONS

Office Action dated Mar. 1, 2022, issued in corresponding Japanese Patent Application No. 2021-100851.

*Primary Examiner* — Michael J Jansen, II
(74) *Attorney, Agent, or Firm* — Morgan, Lewis & Bockius LLP

(57) ABSTRACT

An electroluminescence display apparatus includes a pixel array, including a plurality of pixels, a gate line connected to pixels adjacent thereto in a first direction in common, a data line connected to pixels adjacent thereto in a second direction intersecting with the first direction in common, and a first power line, a second power line, and an initialization voltage supply line connected to all of the plurality of pixels in common, and a panel driving circuit connected to the pixel array.

13 Claims, 11 Drawing Sheets

(56) References Cited

U.S. PATENT DOCUMENTS

| | | | | |
|---|---|---|---|---|
| 9,478,169 | B2 * | 10/2016 | Lim | H01L 27/124 |
| 9,779,662 | B1 * | 10/2017 | Zhang | G09G 3/3233 |
| 10,013,918 | B2 * | 7/2018 | Noh | G09G 3/3266 |
| 10,210,803 | B2 * | 2/2019 | Wu | G09G 3/3233 |
| 10,290,284 | B2 | 5/2019 | Chaji et al. | |
| 10,706,755 | B2 * | 7/2020 | Ju | G09G 3/3258 |
| 10,778,155 | B2 * | 9/2020 | White | H03F 3/45659 |
| 10,825,382 | B2 * | 11/2020 | Kim | G09G 3/3233 |
| 10,839,757 | B2 * | 11/2020 | Park | G09G 3/3233 |
| 10,867,559 | B2 * | 12/2020 | Park | G09G 3/3266 |
| 10,964,267 | B2 * | 3/2021 | Park | G09G 3/3233 |
| 10,991,311 | B2 * | 4/2021 | Yu | G09G 3/3258 |
| 11,233,104 | B2 * | 1/2022 | Park | G09G 3/3258 |
| 2008/0136795 | A1 * | 6/2008 | Numao | G09G 3/3233 345/204 |
| 2009/0167743 | A1 * | 7/2009 | Goh | G09G 3/3233 345/76 |
| 2012/0086742 | A1 | 4/2012 | Ikeda et al. | |
| 2014/0084805 | A1 * | 3/2014 | Kim | G09G 3/2048 315/240 |
| 2014/0168195 | A1 * | 6/2014 | Ku | G09G 3/3233 345/212 |
| 2014/0333214 | A1 * | 11/2014 | Okuno | G09G 3/32 315/172 |
| 2014/0346487 | A1 * | 11/2014 | Asano | G09G 3/30 257/40 |
| 2016/0086546 | A1 * | 3/2016 | Noh | G09G 3/3266 345/80 |
| 2016/0104424 | A1 * | 4/2016 | Lim | H01L 27/1255 345/76 |
| 2016/0247449 | A1 * | 8/2016 | Yin | G09G 3/3233 |
| 2019/0287464 | A1 * | 9/2019 | Park | G09G 3/3275 |
| 2020/0051472 | A1 * | 2/2020 | Ju | G09G 3/006 |
| 2020/0186102 | A1 * | 6/2020 | White | H03F 1/3211 |
| 2020/0279532 | A1 * | 9/2020 | Park | G09G 3/3275 |
| 2021/0043707 | A1 * | 2/2021 | Park | G09G 3/3233 |
| 2021/0193785 | A1 * | 6/2021 | Kim | G09G 3/3233 |

* cited by examiner

ELECTROLUMINESCENCE DISPLAY APPARATUS

This application claims the benefit of Korean Patent Application No. 10-2020-0075693, filed on Jun. 22, 2020, which is hereby incorporated by reference as if fully set forth herein.

BACKGROUND

Technical Field

The present disclosure relates to an electroluminescence display apparatus.

Discussion of the Related Art

Electroluminescence display apparatuses are categorized into inorganic light emitting display apparatuses and organic electroluminescence display apparatuses on the basis of a material of a light emitting layer. Each of a plurality of pixels of the electroluminescence display apparatuses includes a light emitting device self-emitting light and controls the amount of light emitted by the light emitting device by using a data voltage based on a gray level of image data to adjust luminance. A pixel circuit of each pixel may include a driving element.

Based on a process deviation and/or the elapse of a driving time, a threshold voltage of the driving element may vary in each pixel. Also, a threshold voltage of the light emitting device may vary in each pixel. When a driving characteristic deviation between pixels occurs, an emission current contributing to emit light in each pixel may inevitably vary despite the same data voltage being applied thereto. A deviation of the emission current causes non-uniform luminance to degrade image quality.

In the electroluminescence display apparatuses, various researches for compensating for a driving characteristic deviation between pixels are being done, but because a pixel configuration is complicated and the degree of compensation is not sufficient, there is a limitation in securing luminance uniformity.

SUMMARY

Accordingly, embodiments of the present disclosure are directed to an electroluminescence display apparatus that substantially obviates one or more of the problems due to limitations and disadvantages of the related art.

An aspect of the present disclosure is to provide an electroluminescence display apparatus in which a pixel configuration is simplified, and a variation of an emission current caused by a characteristic deviation of each of a driving element and a light emitting device is minimized.

Another aspect of the present disclosure is to provide an electroluminescence display apparatus for enhancing an MPRT characteristic on the basis of a simple driving method.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, an electroluminescence display apparatus comprises a pixel array, including a plurality of pixels, a gate line connected to pixels adjacent thereto in a first direction in common, a data line connected to pixels adjacent thereto in a second direction intersecting with the first direction in common, and a first power line, a second power line, and an initialization voltage supply line connected to all of the plurality of pixels in common, and a panel driving circuit connected to the pixel array.

Each of the plurality of pixels includes a driving element including a gate electrode connected to a first node, a source electrode connected to a high level driving power through the first power line, and a drain electrode connected to a second node, a switching element including a gate electrode connected to the gate line, a source electrode, and a drain electrode, one of the source electrode and the drain electrode being connected to the first node and the other electrode thereof being connected to the second node, a first capacitor connected between the data line and the first node, a second capacitor connected between the initialization voltage supply line and the first node, and a light emitting device including an anode electrode, connected to the second node, and a cathode electrode connected to a low level driving power through the second power line.

The present disclosure may provide an electroluminescence display apparatus in which a pixel configuration is simplified, and a variation of an emission current caused by a characteristic deviation of each of a driving element and a light emitting device is minimized. Moreover, the present disclosure may provide an electroluminescence display apparatus for enhancing an MPRT characteristic on the basis of a simple driving method.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION

Figure 1:
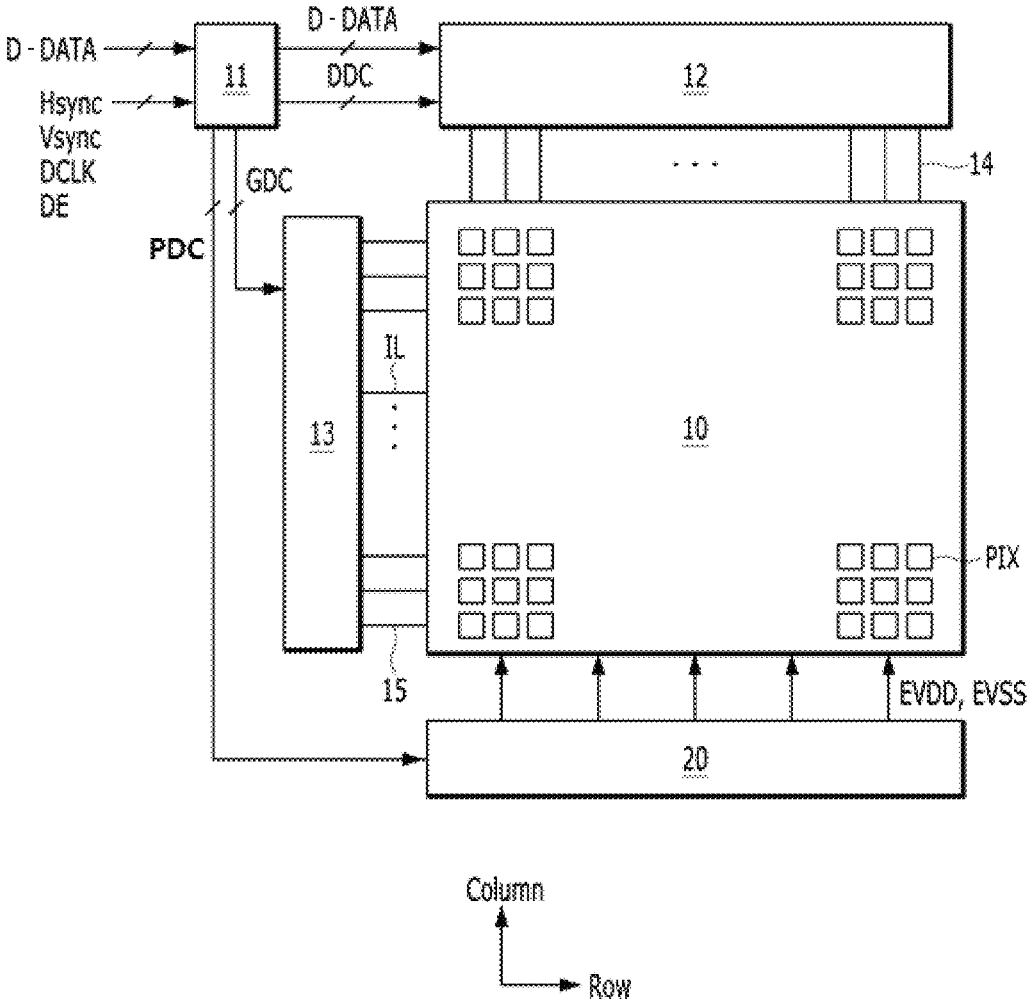
FIG. 1 is a block diagram illustrating an electroluminescence display apparatus according to an embodiment of the present disclosure.

Hereinafter, exemplary embodiments of the present disclosure will be described in detail with reference to the accompanying drawings. In the specification, in adding reference numerals for elements in each drawing, it should be noted that like reference numerals already used to denote like elements in other drawings are used for elements wherever possible. In the following description, when the detailed description of the relevant known function or configuration is determined to unnecessarily obscure the important point of the present disclosure, the detailed description will be omitted.

Figure 2:
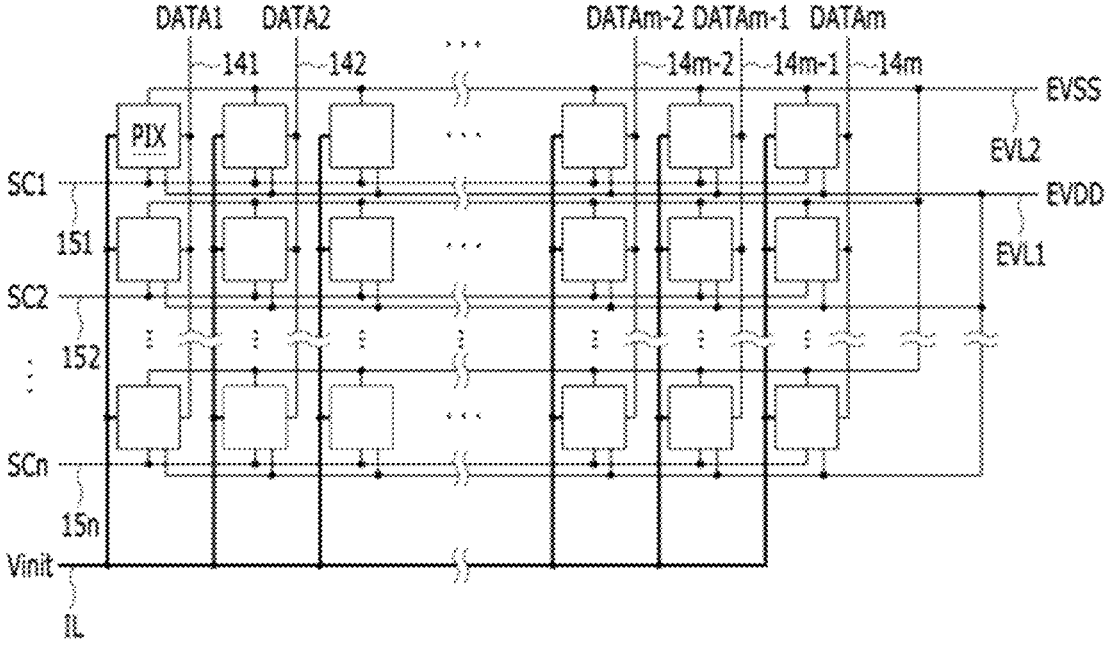
FIG. 2 is a diagram illustrating a pixel array provided in a display panel of FIG. 1.

FIG. 1 is a block diagram illustrating an electroluminescence display apparatus according to an embodiment of the present disclosure. FIG. 2 is a diagram illustrating a pixel array provided in a display panel of FIG. 1.

Referring to FIGS. 1 and 2, the electroluminescence display apparatus according to an embodiment of the present disclosure may include a display panel 10, a timing controller 11, a data driver 12, a gate driver 13, and a power circuit 20. In FIG. 1, all or some of the timing controller 11, the data driver 12, and the power circuit 20 may be integrated into a drive integrated circuit (IC) and may be provided as one body. In FIG. 1, the timing controller 11, the data driver 12, and the power circuit 20 mays configure a panel driving circuit. The panel driving circuit may be connected to a pixel array of the display panel 10 through a plurality of signal lines 14, 15, IL, EVL1, and EVL2.

Referring to FIGS. 1 and 2, in a screen displaying an input image in the display panel 10, a plurality of data lines 14 extending in a column direction (or a vertical direction) and a plurality of gate lines 15 extending in a row direction (or a horizontal direction) may intersect with one another, and a plurality of pixels PIX may be arranged as a matrix type to configure a pixel array in a plurality of intersection areas. Each of the data lines 14 may be connected to pixels PIX adjacent to one another in the row direction in common, and each of the gate lines 15 may be connected to pixels PIX adjacent to one another in the column direction in common. As in FIG. 2, a plurality of data lines 141 to 14*m* may be electrically disconnected from one another, and a plurality of gate lines 151 to 15*n* may be electrically disconnected from one another. The pixel array may further include an initialization voltage supply line IL, a first power line EVL1, and a second power line EVL2, which are connected to all pixels PIX in common.

The pixels PIX included in the pixel array may be grouped into a plurality of pixel groups and may display various colors. When a pixel group for realizing a color is defined as a unit pixel, one unit pixel may include a red (R) pixel, a green (G) pixel, and a blue (B) pixel, and moreover, may include a red (R) pixel, a green (G) pixel, a blue (B) pixel, and a white (W) pixel.

Each of the pixels PIX may include a light emitting device and a driving element which generates an emission current on the basis of a gate-source voltage to drive the light emitting device. The light emitting device may include an anode electrode, a cathode electrode, and an organic compound layer formed therebetween. The organic compound layer may include a hole injection layer (HIL), a hole transport layer (HTL), an emission layer (EML), an electron transport layer (ETL), and an electron injection layer (EIL), but is not limited thereto. When a pixel current flows in the light emitting device, a hole passing through the hole transport layer (HIL) and an electron passing through the electron transport layer (ETL) may move to the emission layer (EML) to generate an exciton, and thus, the emission layer (EML) may emit visible light. The organic compound layer may be replaced with an inorganic compound layer.

The driving element may be implemented with a low temperature polysilicon (LTPS) or oxide thin film transistor (TFT) based on an organic substrate (or a plastic substrate), but is not limited thereto. The driving element may be implemented with a CMOS transistor based on a silicon wafer. An electrical characteristic (for example, a threshold voltage, electron mobility, and the like) of the driving element should be uniform in all pixels, but may have a difference which occurs between the pixels PIX due to a process deviation and an element characteristic deviation. The electrical characteristic of the driving element may be changed as a display driving time elapses, and due to this, the degree of degradation may have a difference between the pixels PIX. In order to compensate for an electrical characteristic deviation of the driving element, an internal compensation method may be applied to the electroluminescence display apparatus. The internal compensation method may compensate for the electrical characteristic deviation of the driving element by using an internal compensator included in a pixel circuit of each pixel so that an electrical characteristic change of the driving element does not adversely affect the emission current. The internal compensator may include a plurality of switching elements, each including a TFT (or a CMOS transistor), and at least one capacitor.

Research for implementing some elements (for example, a switching element where a source or a drain thereof is connected to a gate of the driving element) of the pixel circuit by using an oxide transistor is increasing. The oxide transistor may include a semiconductor material, and for example, may include oxide such as indium gallium zinc oxide (IGZO) instead of polysilicon. The oxide transistor may have electron mobility, which is 10 or more times the electron mobility of an amorphous silicon transistor, and may be far lower in manufacturing cost than the LTPS transistor. Also, because an off current of the oxide transistor is low, the driving stability and reliability of the oxide transistor may be high in low-speed driving where an off period of a transistor is relatively long. Accordingly, the oxide transistor may be applied to organic light emitting diode (OLED) televisions (TVs) which need a high resolution and low-power driving or do not implement a suitable screen size through an LTPS process.

In an embodiment of the present disclosure, in order to increase both driving stability and compensation reliability, the driving element and the switching element included in the pixel circuit of each pixel PIX may be implemented with a P-channel (PMOS) transistor. The transistor may each be a three-electrode element including a gate, a source, and a drain. The source may be an electrode which supplies a carrier to the transistor. In the transistor, the carrier may start to flow from the source. The drain may be an electrode which enables the carrier to flow out from the transistor. In the transistor, the carrier may flow from the source to the drain. In a P-channel transistor, because the carrier is a hole, a source voltage may be higher than a drain voltage so that the hole flows from the source to the drain. In the P-channel transistor, because the hole flows from the source to the drain, a current may flow from the source to the drain. Particularly, it should be noted that the source and the drain of the transistor are not fixed. For example, the source and the drain may switch therebetween on the basis of a voltage applied thereto. Accordingly, the present disclosure is not limited by the source and the drain of the transistor.

Referring to FIGS. 1 and 2, the timing controller 11 may provide the data driver 12 with digital image data D-DATA transferred from a host system (not shown). The timing controller 11 may receive a timing signal, including a vertical synchronization signal Vsync, a horizontal synchronization signal Hsync, a data enable signal DE, and a dot clock DCLK, from the host system to generate a plurality of timing control signals for an operation timing of the panel driving circuit. The timing control signals may include a gate timing control signal GDC for controlling an operation timing of the gate driver 13, a data timing control signal DDC for controlling an operation timing of the data driver 12, and a power timing control signal PDC for controlling an operation timing of the power circuit 20.

The timing controller 11 may control an operation of the panel driving circuit so that a temporary emission method is implemented. To this end, the timing controller 11 may temporary divide a one-frame period into an initialization period, a programming period succeeding the initialization period, and an emission period succeeding the programming period. The timing controller 11 may control an operation of the panel driving circuit so that all pixels PIX are simultaneously initialized in the initialization period. The timing controller 11 may control an operation of the panel driving circuit so that the pixels PIX are programmed in the programming period on the basis of a row line progressive scheme. The timing controller 11 may control an operation of the panel driving circuit so that all pixels PIX emit pieces of light simultaneously in the emission period.

Referring to FIGS. 1 and 2, the data driver 12 may be connected to the pixels PIX through the data lines 14. The data driver 12 may generate analog voltages DATA1 to DATAm needed for driving of the pixels PIX and may supply the analog voltages DATA1 to DATAm to the data lines 141 to 14*m*. Each of the analog voltages DATA1 to DATAm may include a data voltage and a reference voltage.

The data driver 12 may sample and latch the digital image data D-DATA input from the timing controller 11 on the basis of the timing control signal DDC to generate parallel data, and a digital-to-analog converter (DAC) may convert the digital image data D-DATA into analog data voltages on the basis of gamma compensation voltages and may supply the data voltages to the pixels PIX through the data lines 14. The data voltages may have analog voltage values corresponding to different voltage levels based on image gray levels which are to be realized in the pixels PIX. The data driver 12 may further generate a reference voltage on the basis of the data control signal DDC and may supply the reference voltage to the pixels PIX through the data lines 14. The reference voltage may have a predetermined fixed voltage level.

The data driver 12 may output the data voltages in the programming period on the basis of the data timing control signal DDC and may output the reference voltage in the initialization period and the emission period. The data driver 12 may be configured with a plurality of source drive ICs. Each of the source drive ICs may include a shift register, a latch, a level shifter, and an output buffer.

Referring to FIGS. 1 and 2, the gate driver 13 may be connected to the pixels PIX through the gate lines 15 and may be connected to the pixels PIX through an initialization voltage supply line IL.

The gate driver 13 may generate a plurality of scan signals SC1 to SCn on the basis of the gate timing control signal GDC and may supply the scan signals SC1 to SCn to the gate lines 151 to 15*n*. Each of the scan signals SC1 to SCn may be generated as a pulse type which swings between a gate-on voltage and a gate-off voltage. The gate-on voltage may be set to a voltage which is higher than a threshold voltage of a transistor. The transistor may be turned on in response to the gate-on voltage, and in response to the gate-off voltage, the transistor may be turned off. In a P-channel transistor, the gate-on voltage may be a gate low voltage VGL, and the gate-off voltage may be a gate high voltage VGH. Hereinafter, the gate low voltage VGL may be expressed as an on level, and the gate high voltage VGH may be expressed as an off level.

The gate driver 13 may generate the pulse type scan signals SC1 to SCn which swing between the off level and the on level, on the basis of the gate timing control signal GDC and may allow an output timing of the pulse type scan signals SC1 to SCn to correspond to a supply timing of a data voltage. In other words, the gate driver 13 may sequentially supply the scan signals SC1 to SCn having an on level to the gate lines 151 to 15*n* in the programming period, and in the initialization period, the gate driver 13 may sequentially supply the scan signals SC1 to SCn having an off level to the gate lines 151 to 15*n*.

The gate driver 13 may generate a first initialization voltage Vinit toggled between a low voltage level and a high voltage level in the initialization period on the basis of the gate timing control signal GDC and may supply the first initialization voltage Vinit to the initialization voltage supply line IL. Also, in the programming period and the emission period, thegate driver 13 may generate a second initialization voltage Vinit having a low voltage level and may supply thesecond initialization voltage Vinit having a low voltage level to the initialization voltage supply line IL. The initialization voltage supply line IL may be connected to all pixels PIX in common, and thus, the driving elements of the pixels PIX may be simultaneously turned on by the first initialization voltage Vinit having a high voltage level in the initialization period.

The gate driver 13 may include a gate shift register, a level shifter which shifts an output signal of the gate shift register to a switch width suitable for driving of a transistor of a pixel, and a plurality of gate drive ICs each including an output buffer. Alternatively, the gate driver 13 may be implemented directly on a substrate of the display panel 10 on the basis of a gate driver in panel (GIP) type. In the GIP type, the level shifter may be mounted on a printed circuit board (PCB), and the gate shift register may be provided in a bezel area which is a non-display area of the display panel 10. The gate shift register may include a plurality of scan output stages which are connected to one another in a cascade type. The scan output stages may be independently connected to the gate lines 151 to 15*n* and may output the scan signals SC1 to SCn to the gate lines 151 to 15*n*. The gate shift register may further include one initialization output stage. The initialization output stage may be connected to the initialization voltage supply line IL and may output the first or second initialization voltage Vinit to the initialization voltage supply line IL.

Referring to FIGS. 1 and 2, the power circuit 20 may be connected to the pixels PIX through the first power line EVL1 and may be connected to the pixels PIX through the second power line EVL2.

The power circuit 20 may process an input voltage on the basis of the power timing control signal PDC to generate a high level driving power EVDD having a first voltage level, which is fixed, and may supply the high level driving power EVDD to the pixels PIX through the first power line EVL1. Also, the power circuit 20 may process the input power on the basis of the power timing control signal PDC to generate a low level driving power EVSS which swings between a second voltage level and a third voltage level and may supply the low level driving power EVSS to the pixels PIX through the second power line EVL2. Here, the second voltage level may be lower than the first voltage level and higher than the third voltage level.

The power circuit 20 may shift the low level driving power EVSS to the second voltage level in the initialization period and the programming period on the basis of the power timing control signal PDC, and thus, may prevent the undesired light emission of all pixels PIX during the initialization period and the programming period.

The host system may act as an application processor (AP) in mobile devices, wearable devices, virtual/augmented reality devices, and the like. Also, the host system may be a main board for TV systems, set-top box, navigation systems, personal computers, and home theater systems.

Figure 3:
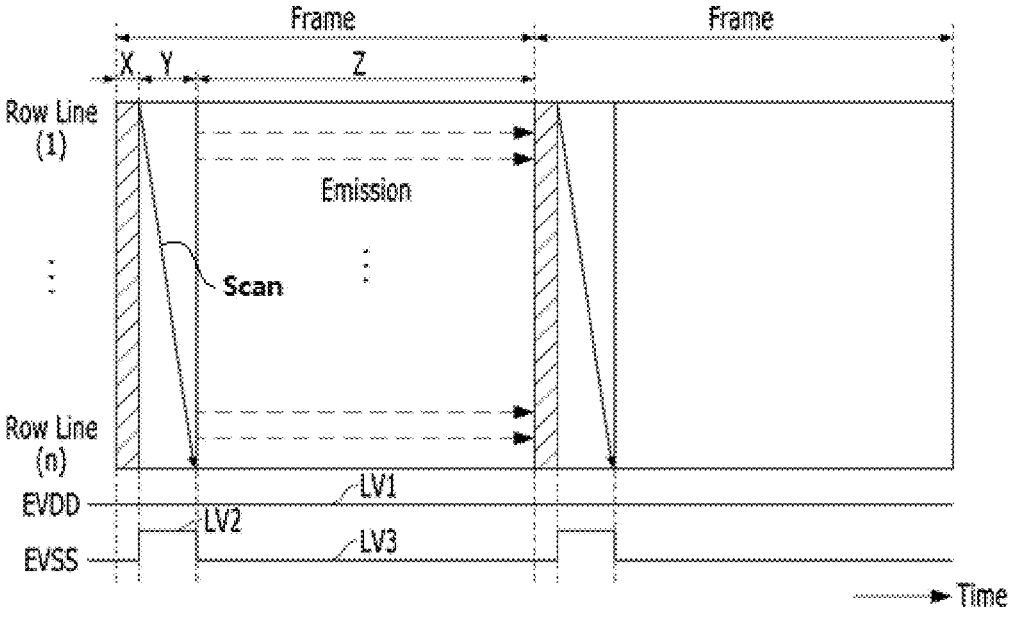
FIGS. 3 and 4 are diagrams illustrating a driving timing of a temporary emission method according to an embodiment of the present disclosure.
Figure 4:
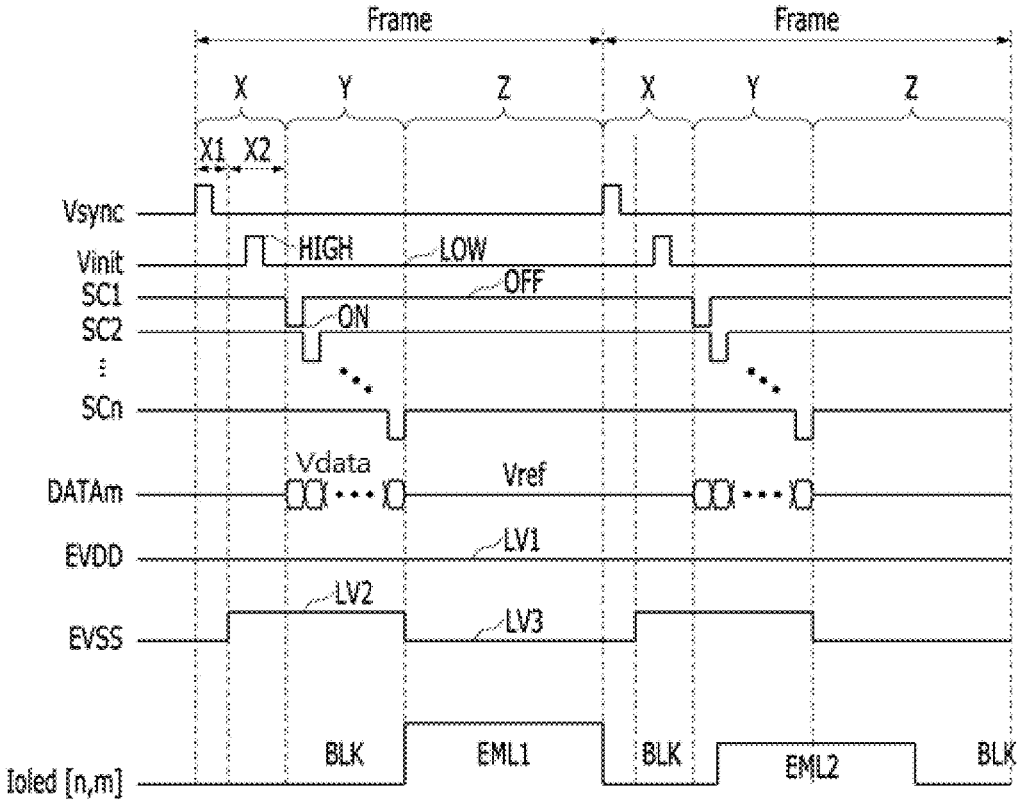

FIGS. 3 and 4 are diagrams illustrating a driving timing of a temporary emission method according to an embodiment of the present disclosure.

Referring to FIGS. 3 and 4, the temporary emission method according to an embodiment of the present disclosure may be a method proposed for enhancing a motion picture response time (MPRT) in the electroluminescence display apparatus which is a hold type apparatus. The temporary emission method may enhance the MPRT characteristic by using a driving method which is simpler than a black data insertion (BDI) method of the related art. In the BDI method, because a separate black voltage should be applied for displaying a black image subsequent to an original image in the same frame, the cost may increase and a driving scheme may be complicated. On the other hand, in the temporary emission method, because it is not needed to apply a separate black voltage, a problem caused by the BDI method may be solved. Also, in the temporary emission method, because the emission period is adjustable to be relatively long in one frame, high luminance may be realized at the low cost.

In the temporary emission method, all pixels may be simultaneously initialized to the first initialization voltage Vinit in an initialization period X, a data voltage Vdata may be applied to the pixels by low line units in a programming period Y, and all pixels may simultaneously emit pieces of light in an emission period Z. To this end, a high level driving power EVDD may be set to be fixed to a first voltage level LV1, and a low level driving power EVSS may be set to swing between a second voltage level LV2 and a third voltage level LV3. The low level driving power EVSS may be applied at the second voltage level LV2 in the initialization period X and the programming period Y and may be applied at the third voltage level LV3, which is lower than the second voltage level LV2, in the emission period Z.

The initialization period X may include a first initialization period X1, where a pulse of a vertical synchronization signal Vsync is supplied, and a second initialization period X2 where the first initialization voltage Vinit having a high voltage level HIGH is supplied. The low level driving power EVSS may be applied at the second voltage level LV2 from the second initialization period X2 as illustrated in FIG. 4, but is not limited thereto and may be applied at the second voltage level LV2 from the first initialization period X1.

In the programming period Y, the data voltage Vdata may be sequentially supplied to a plurality of data lines by low line units. Also, in order for the data voltage Vdata to be applied to the pixels by low line units, a plurality of scan signals SC1 to SCn having an on level ON may be applied to a plurality of gate lines in synchronization with an application timing of the data voltage Vdata.

In the initialization period X and the emission period Z, a reference voltage Vref differing from the data voltage Vdata may be applied to the data lines. The data voltage Vdata and the reference voltage Vref may each be a factor for determining an emission current in the emission period Z.

The emission current may be "0" in the initialization period X and the programming period Y, and thus, light emitting devices of all pixels may not emit light. A display image implemented in the pixels may be a black image BLK during the initialization period X and the programming period Y, and the MPRT may be improved by the black image BLK.

On the other hand, the emission current may be set to have brightness proportional to the square of a difference between the data voltage Vdata and the reference voltage Vref in the emission period Z, and the light emitting devices of all pixels may emit pieces of light with the emission current. In the emission period Z, a display image implemented in the pixels may represent grayscale brightness EML1 or EML2, and the grayscale brightness may vary by pixel units. This is because the data voltage Vdata is programmed differently for each pixel.

Figure 5:
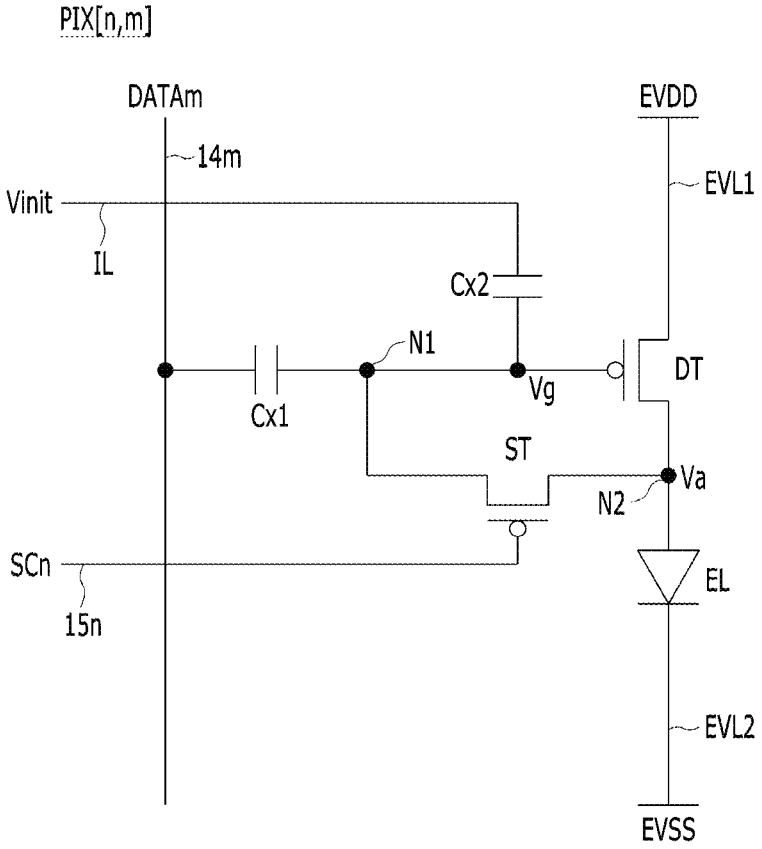
FIG. 5 is a diagram illustrating an equivalent circuit of a pixel driven based on the temporary emission method.

FIG. 5 is a diagram illustrating an equivalent circuit of a pixel driven based on the temporary emission method.

Referring to FIG. 5, a pixel circuit of a pixel connected to an $n^{th}$ gate line 15*n* and an $m^{th}$ data line 14*m* may include a driving element DT, a light emitting device EL, and an internal compensator.

The driving element DT may generate a current for driving the light emitting device EL. A gate electrode of the driving element DT may be connected to a first node N1, a source electrode thereof may be connected to a high level driving power EVDD through a first power line EVL1, and a drain electrode thereof may be connected to a second node N2. In order to minimize a variation of an emission current caused by a characteristic change of the light emitting device EL, the driving element DT may be implemented with a P-channel transistor. In a case where the driving element DT is implemented with the P-channel transistor, a source voltage of the driving element DT may be fixed to a high level driving power EVDD regardless of a characteristic change of the light emitting device EL, and thus, luminance uniformity may be easily secured.

The light emitting device EL may include an anode electrode connected to the second node N2, a cathode electrode connected to a low level driving power EVSS through a second power line EVL2, and a light emitting layer disposed therebetween. The light emitting device EL may be implemented with an OLED including an organic light emitting layer, or may be implemented with an inorganic light emitting diode including an inorganic light emitting layer.

The internal compensator may be for compensating for a variation of a threshold voltage of the driving element DT and may be configured with one switching element ST and two capacitors (for example, first and second capacitors) Cx1 and Cx2. The internal compensator may sample the threshold voltage of the driving element DT and may reflect the sampled threshold voltage in a gate voltage Vg of the driving element DT. Despite the variation of the threshold voltage of the driving element DT, the internal compensator may perform compensation so that the emission current is not adversely affected thereby. Therefore, a compensation operation on the variation of the threshold voltage of the driving element DT may be performed in a pixel. Such an internal compensation operation should be differentiated from an external compensation operation of correcting digital image data so as to compensate for an electrical characteristic change of the driving element DT.

The switching element ST may be electrically connected (diode-connected) to the gate electrode and the drain electrode of the driving element DT, and thus, may sample the threshold voltage of the driving element DT. A gate electrode of the switching element ST may be connected to the gate line 15*n*, one of a drain electrode and a source electrode thereof may be connected to the first node N1, and the other electrode of the drain electrode and the source electrode thereof may be connected to the second node N2. The switching element ST may be turned on based on the scan signal SCn having an on level ON, which is supplied through the gate line 15*n*. When the switching element ST is turned on, the driving element DT may be diode-connected thereto. The switching element ST may be implemented with a P-channel transistor. When the switching element ST is implemented with the P-channel transistor, an off current (or a leakage current) may decrease by twice or more compared to a case where the switching element ST is implemented with an N-channel transistor. As a result, a voltage holding ratio (VHR) may increase, and thus, driving stability and reliability may be enhanced.

The first capacitor Cx1 may be connected between the data line 14*m* and the first node N1 and may reflect the analog voltage DATAm (a data voltage or a reference voltage), supplied through the data line 14*m*, in the first node N1 through coupling. In order to reflect the analog voltage 14*m* in the first node N1, a concept of using the first capacitor Cx1 may more decrease and simply the number of gate lines and a configuration of the gate driver than a concept of using a separate switch transistor.

The second capacitor Cx2 may be connected between the initialization voltage supply line IL and the first node N1 and may reflect the first and second initialization voltage Vinit, supplied through the initialization voltage supply line IL, in the first node N1 through coupling. In order to reflect the first and second initialization voltage Vinit in the first node N1, a concept of using the second capacitor Cx2 may more decrease and simply the number of gate lines and the configuration of the gate driver than the concept of using a separate switch transistor.

A capacity of the second capacitor Cx2 may be designed to be greater than that of the first capacitor Cx1. When the capacity of the second capacitor Cx2 is designed to be greater than that of the first capacitor Cx1, a range V0 to V255 of a data voltage for realizing a gray level of an image may extend. Therefore, a minimum voltage difference (for example, V255 to V254) between adjacent grayscale voltages may increase, and thus, it is possible to implement a circuit which is insensitive to an offset of an operational amplifier OPAMP configuring an output buffer of a source drive IC. As a result, when the capacity of the second capacitor Cx2 is designed to be greater than that of the first capacitor Cx1, an adverse influence of the offset may not occur, and thus, a gray level may be accurately realized and image quality may be enhanced.

As described above, because the pixel circuit includes only two transistors, two capacitors, and one light emitting device, a configuration of the pixel circuit may be very simple. When the configuration of the pixel circuit is simplified, an area occupied by each pixel in the pixel array may be reduced, and thus, pixel per inch (PPI) may increase.

Figure 6:
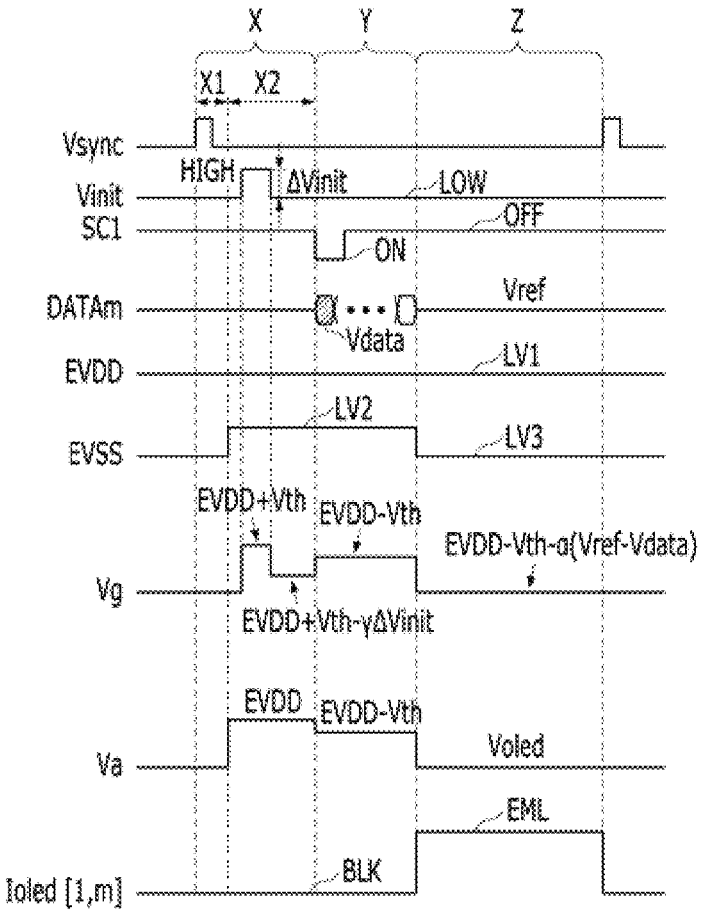
FIG. 6 is a diagram illustrating a driving timing of a pixel connected to a first gate line and an $m^{th}$ data line.
Figure 7A:
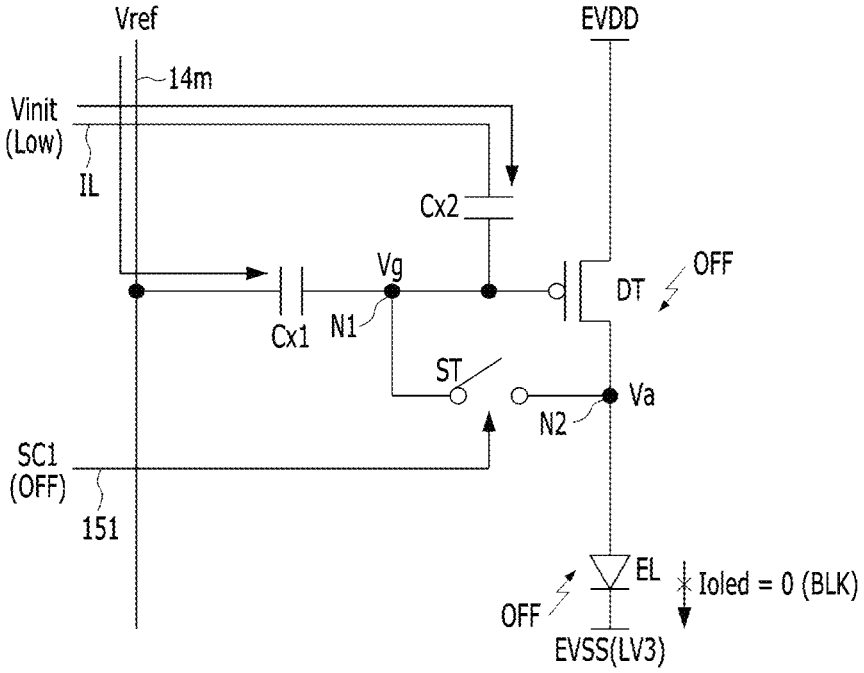
FIG. 7A is a diagram illustrating an operation of a pixel in a first initialization period of FIG. 6.
Figure 7B:
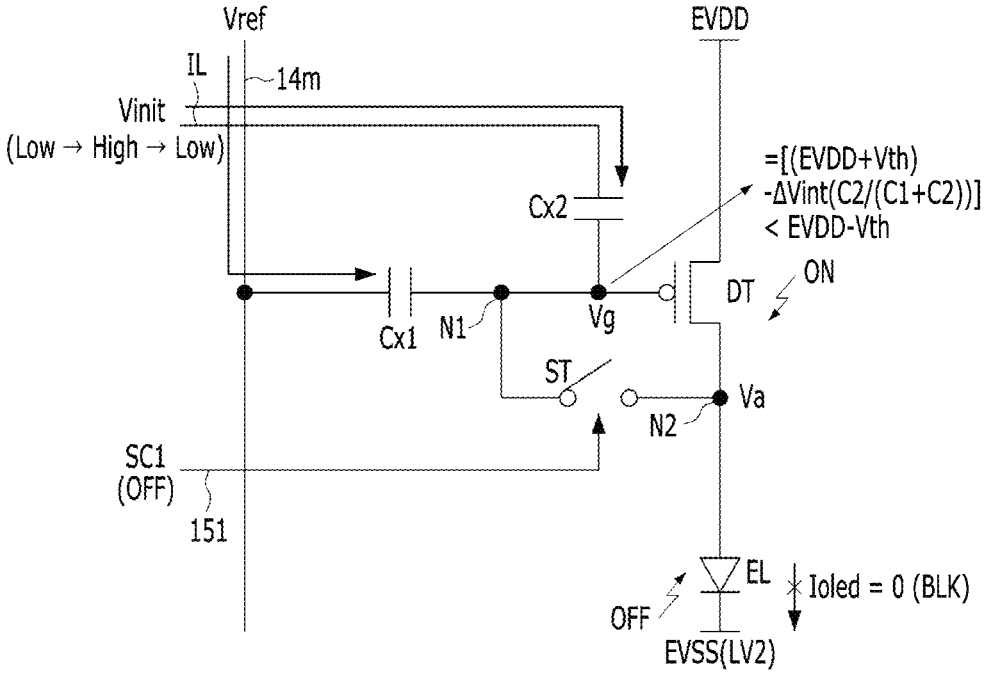
FIG. 7B is a diagram illustrating an operation of a pixel in a second initialization period of FIG. 6.
Figure 7C:
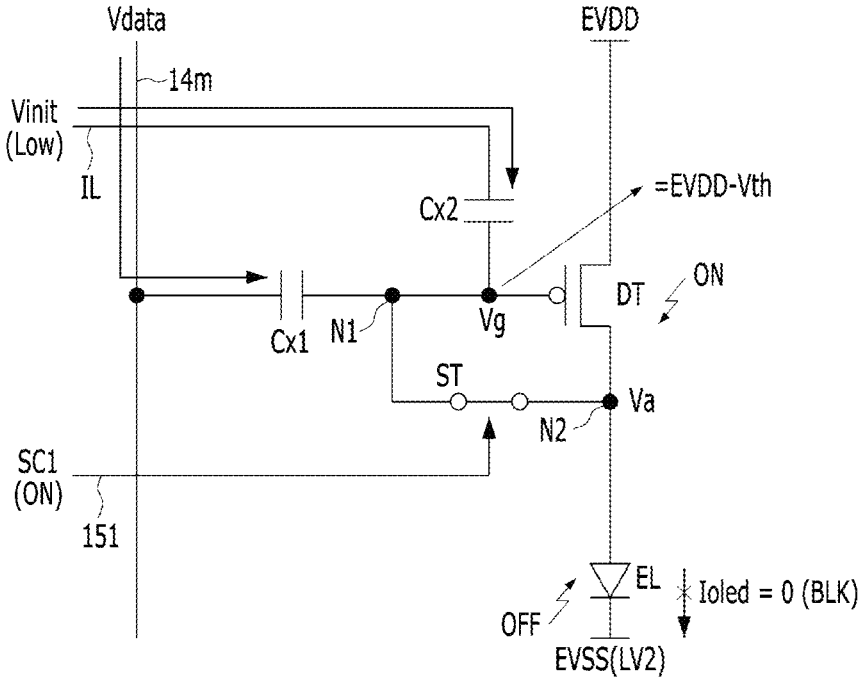
FIG. 7C is a diagram illustrating an operation of a pixel in a programming period of FIG. 6.
Figure 7D:
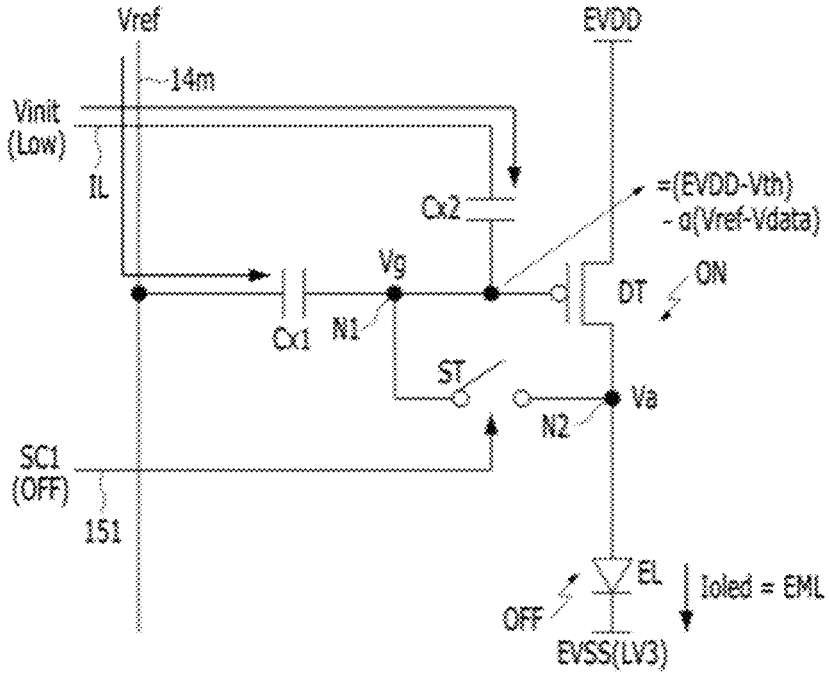
FIG. 7D is a diagram illustrating an operation of a pixel in an emission period of FIG. 6.

FIG. 6 is a diagram illustrating a driving timing of a pixel connected to a first gate line and an $m^{th}$ data line. FIG. 7A is a diagram illustrating an operation of a pixel in a first initialization period of FIG. 6. FIG. 7B is a diagram illustrating an operation of a pixel in a second initialization period of FIG. 6. FIG. 7C is a diagram illustrating an operation of a pixel in a programming period of FIG. 6. FIG. 7D is a diagram illustrating an operation of a pixel in an emission period of FIG. 6.

Referring to FIGS. 6 and 7A, an initialization voltage Vinit having a low voltage level LOW, a scan signal SC1 having an off level OFF, a reference voltage Vref, a high level driving power EVDD having a first voltage level LV1, and a low level driving power EVSS shifted from a third voltage level LV3 to a second voltage level LV2 may be applied to a pixel in a first initialization period X1. A switching element ST may be turned off, and moreover, a driving element DT may be turned off. Also, a light emitting device EL may be turned off by the low level driving power EVSS having the second voltage level LV2.

Referring to FIGS. 6 and 7B, the initialization voltage Vinit toggled between the low voltage level LOW and a high voltage level HIGH, the scan signal SC1 having an off level OFF, the reference voltage Vref, the high level driving power EVDD having the first voltage level LV1, and the low level driving power EVSS having the second voltage level LV2 may be applied to the pixel in a second initialization period X2. The switching element ST may be turned off by the scan signal SC1 having an off level OFF. A gate voltage Vg of the driving element DT may be set to "EVDD+Vth−γΔVinit" which is lower than "EVDD−Vth", on the basis of the initialization voltage Vinit toggled to LOW-HIGH-LOW. Here, "γ" may denote C2/(C1+C2), "C1" may denote a capacity of a first capacitor Cx1, and "C2" may denote a capacity of a second capacitor Cx2. Also, "ΔVinit" may denote a difference voltage between the high voltage level HIGH and the low voltage level LOW of the initialization voltage Vinit. The driving element DT may be turned on, and thus, a drain voltage Va of the driving element DT may be "EVDD". The light emitting device EL may maintain a turn-off state (i.e., a black state BLK) on the basis of the low level driving power EVSS having the second voltage level LV2.

Referring to FIGS. 6 and 7C, the initialization voltage Vinit having the low voltage level LOW, the scan signal SC1 having an on level ON, a data voltage Vdata, the high level driving power EVDD having the first voltage level LV1, and the low level driving power EVSS having the second voltage level LV2 may be applied to the pixel in a programming period Y. The switching element ST may be turned on by the scan signal SC1 having the on level ON and may connect a gate electrode and a drain electrode of the driving element DT which maintains a turn-on state. The driving element DT may be diode-connected, and thus, a threshold voltage Vth of the driving element DT may be sampled and may be reflected in a gate voltage Vg and a drain voltage Va of the driving element DT. In other words, the gate voltage Vg and the drain voltage Va of the driving element DT may be "EVDD-Vth". The light emitting device EL may maintain a turn-off state (i.e., the black state BLK) on the basis of the low level driving power EVSS having the second voltage level LV2. The data voltage Vdata may be charged into one electrode of the first capacitor Cx1.

Referring to FIGS. 6 and 7D, the initialization voltage Vinit having the low voltage level LOW, the scan signal SC1 having the off level OFF, the reference voltage Vref, the high level driving power EVDD having the first voltage level LV1, and the low level driving power EVSS having the third voltage level LV3 may be applied to the pixel in an emission period Y. The switching element ST may be turned off by the scan signal SC1 having the off level OFF and may release a connection between a gate electrode and a drain electrode of the driving element DT. A voltage at one electrode of the first capacitor Cx1 may be changed from the data voltage Vdata to the reference voltage Vref. A voltage variation "Vref−Vdata" of the first capacitor Cx1 may be reflected in the first node N1 on the basis of a coupling effect. As a result, the gate voltage Vg of the driving element DT may be "(EVDD−Vth)−α(Vref−Vdata)". Here, "α" may be "C1/(C1+C2)". The drain voltage Va of the driving element DT may be set to a threshold voltage Voled of the light emitting device EL on the basis of a current flowing in the driving element DT. At this time, the light emitting device EL may be put in a turn-on state (i.e., an emission state EML) by the low level driving power EVSS having the third voltage level LV3. An emission current Ioled flowing in the light emitting device EL may be determined as the following Equation 1 irrelevant to the threshold voltage Vth of the driving element DT.

$$\text{Ioled}=k[\alpha(\text{Vref}-\text{Vdata})]^2 \quad \text{[Equation 1]}$$

In Equation 1, K may denote a constant value which is determined based on an electron mobility, a parasitic capacity, and a channel capacity of the driving element, α may denote C1/(C1+C2), C1 may denote a capacity of the first capacitor, C2 may denote a capacity of the second capacitor, Vref may denote the reference voltage, and Vdata may denote the data voltage.

Figure 8:
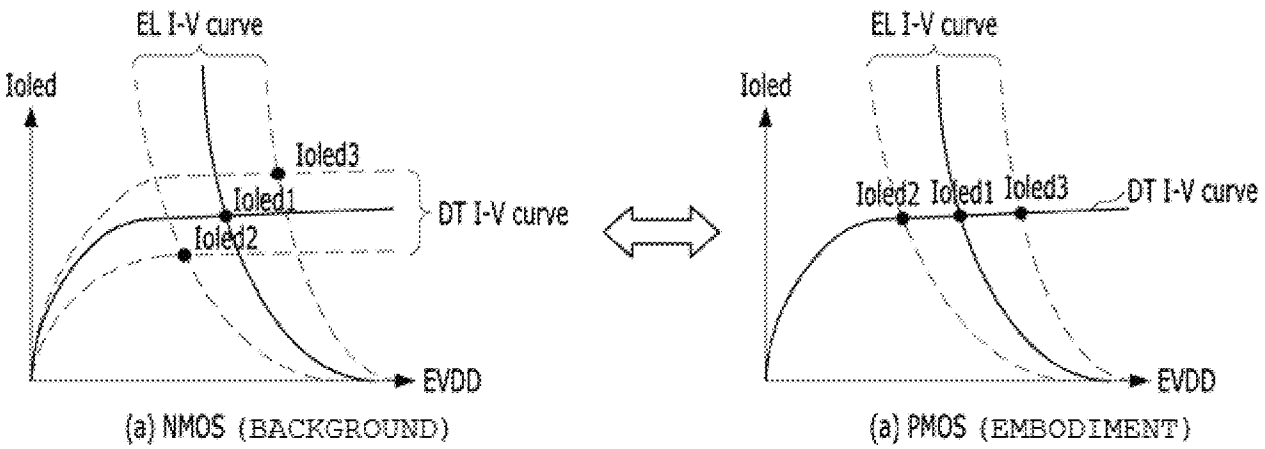
FIG. 8 is a diagram illustrating a result obtained by comparing the related art with a variation of an emission current, with respect to a characteristic change of a light emitting device.

FIG. 8 is a diagram illustrating a result obtained by comparing the related art with a variation of an emission current, with respect to a characteristic change of a light emitting device.

The first portion of FIG. 8 shows a variation of an emission current with respect to a change (for example, degradation) in characteristic (for example, a temperature and the like) of a light emitting device, when a driving element is implemented with an NMOS transistor. Also, the second portion of FIG. 8 shows a variation of the emission current with respect to a change (for example, degradation) in characteristic (for example, a temperature and the like) of the light emitting device, when the driving element is implemented with a PMOS transistor. In the graphs of FIG. 8, the ordinate axis represents an emission current Ioled, and the abscissa axis represents a high level driving power EVDD.

Referring to FIG. 8, when an emission current flows in a light emitting device for a long time on the basis of full white brightness, the light emitting device is degraded, and thus, an EL current-voltage curve showing an operation of the light emitting device may be changed from a solid line to a dotted line.

In this case, as in the first portion of FIG. 8, in a model (comparative technology) where a driving element is implemented with an NMOS transistor, a source voltage of the driving element is changed due to a degradation in a light emitting device, and based thereon, a DT current-voltage curve showing an operation of the driving element may be changed from a solid line to a dotted line. Therefore, an operation point at which an EL current-voltage curve intersects with the DT current-voltage curve is changed from Ioled1 to Ioled2 or Ioled3. A current deviation between Ioled2 or Ioled3 and Ioled1 is large. Due to this, undesired luminance distortion may occur.

On the other hand, as in the second portion of FIG. 8, in a model (an embodiment of the present disclosure) where a driving element is implemented with a PMOS transistor, a drain voltage, instead of a source voltage, of the driving element is changed due to a degradation in a light emitting device and the source voltage is fixed, and thus, a DT current-voltage curve showing an operation of the driving element may maintain a solid line. Also, even when an operation point at which an EL current-voltage curve intersects with the DT current-voltage curve is changed from Ioled1 to Ioled2 or Ioled3, a current deviation may hardly occur between Ioled2 or Ioled3 and Ioled1, and thus, the occurrence of undesired luminance distortion may be prevented.

As described above, according to the embodiments of the present disclosure, the following effects may be obtained.

According to the embodiments of the present disclosure, an emission current may be set by using a simple pixel configuration including a PMOS transistor regardless of a variation of a threshold voltage of a driving element, thereby increasing the reliability of products and driving stability.

According to the embodiments of the present disclosure, the distortion of the emission current caused by a change (for example, degradation) in characteristic (for example, a temperature and the like) of a light emitting device may be minimized by using the simple pixel configuration including the PMOS transistor, thereby increasing the reliability of products and driving stability.

According to the embodiments of the present disclosure, a VHR characteristic may be enhanced by using the simple pixel configuration including the PMOS transistor, thereby increasing the reliability of products and driving stability.

According to the embodiments of the present disclosure, an area occupied by each pixel in a pixel array may be reduced by using the simple pixel configuration including the PMOS transistor, thereby increasing PPI.

According to the embodiments of the present disclosure, by using the temporary emission method, an MPRT characteristic may be enhanced based on a driving method which is simpler than a conventional BDI method.

The effects according to the present disclosure are not limited to the above examples, and other various effects may be included in the specification.

It will be apparent to those skilled in the art that various modifications and variations can be made in the electroluminescence display apparatus of the present disclosure without departing from the technical idea or scope of the disclosure. Thus, it is intended that the present disclosure cover the modifications and variations of this disclosure provided they come within the scope of the appended claims and their equivalents.

What is claimed is:

1. An electroluminescence display apparatus, comprising:

a pixel array including a plurality of pixels, a gate line connected to pixels adjacent thereto in a first direction in common, a data line connected to pixels adjacent thereto in a second direction intersecting with the first direction in common, and a first power line, a second power line, and an initialization voltage supply line connected to all of the plurality of pixels in common; and a panel driving circuit connected to the pixel array, wherein each of the plurality of pixels comprises:

a driving element including a gate electrode connected to a first node, a source electrode connected to the first power line to receive a high level driving power, and a drain electrode connected to a second node;

a switching element including a gate electrode connected to the gate line, a source electrode, and a drain electrode, one of the source electrode and the drain electrode being connected to the first node and the other electrode thereof being connected to the second node;

a first capacitor connected between the data line and the first node;

a second capacitor connected between the initialization voltage supply line and the first node; and a light emitting device including an anode electrode, connected to the second node, and a cathode electrode connected to the second power line to receive a low level driving power, wherein each of the gate electrode of the driving element, one electrode of the first capacitor, one of the source electrode and the drain electrode of the switching element, and one electrode of the second capacitor is directly connected to the first node, wherein a gate driver included in the panel driving circuit is configured to:

in an initialization period, generate a first initialization voltage toggled between a low voltage level and a high voltage level to supply a first initialization voltage to the initialization voltage supply line; and in a programming period and an emission period, generate a second initialization voltage having the low voltage level to supply the second initialization voltage to the initialization voltage supply line.

2. The electroluminescence display apparatus of claim 1, wherein one of the driving element and the switching element is implemented with a P-channel transistor.

3. The electroluminescence display apparatus of claim 1, wherein a capacity of the second capacitor is greater than a capacity of the first capacitor.

4. The electroluminescence display apparatus of claim 1, wherein the high level driving power is maintained at a first voltage level, the low level driving power swings between a second voltage level and a third voltage level, and the second voltage level is lower than the first voltage level and higher than the third voltage level.

5. The electroluminescence display apparatus of claim 4, wherein a one-frame period comprises the initialization period, the programming period succeeding the initialization period, and the emission period succeeding the programming period, in the initialization period and the programming period, the light emitting devices of the plurality of pixels are configured to be simultaneously turned off based on the low level driving power having the second voltage level, and in the emission period, the light emitting devices of the plurality of pixels are configured to be simultaneously turned on based on the low level driving power having the third voltage level.

6. The electroluminescence display apparatus of claim 5, wherein a power circuit included in the panel driving circuit is configured to:

supply the high level driving power having the first voltage level to the first power line in the one-frame period, supply the low level driving power having the second voltage level to the second power line in the initialization period and the programming period, and supply the low level driving power having the third voltage level to the second power line in the emission period.

7. The electroluminescence display apparatus of claim 5, wherein a data driver included in the panel driving circuit is configured to:

supply a reference voltage to the data line in the initialization period and the emission period, and supply a data voltage different from the reference voltage to the data line in the programming period.

8. The electroluminescence display apparatus of claim 7, wherein the gate driver included in the panel driving circuit is configured to:

generate a pulse type scan signal swinging between an off level and an on level, supply the pulse type scan signal having the on level to the gate line in the programming period, and supply the pulse type scan signal having the off level to the gate line in the initialization period and the emission period.

9. The electroluminescence display apparatus of claim 8, wherein a supply timing of the pulse type scan signal corresponds to a supply timing of the data voltage.

10. The electroluminescence display apparatus of claim 9, wherein, in the initialization period, the driving element satisfies a turn-on condition based on the toggled first initialization voltage.

11. The electroluminescence display apparatus of claim 10, wherein, in the programing period, as the driving element and the switching element are configured to be turned on, the electroluminescence display apparatus is configured to store EVDD-Vth in the first node, and EVDD is the high level driving power having the first voltage level, and Vth is a threshold voltage of the driving element.

12. The electroluminescence display apparatus of claim 11, wherein the electroluminescence display apparatus is configured to determine an emission current Ioled flowing in the light emitting device in the emission period according to the following Equation 1 irrelevant to a threshold voltage of the driving element, $$Ioled\ k[\alpha(Vref-Vdata)] \quad \text{[Equation 1]}$$

in Equation 1, k denotes a constant value which is determined based on an electron mobility, a parasitic capacity, and a channel capacity of the driving element, $\alpha$ denotes C1/(C1+C2), C1 denotes a capacity of the first capacitor, C2 denotes a capacity of the second capacitor, Vref denotes the reference voltage, and Vdata denotes the data voltage.

13. The electroluminescence display apparatus of claim 1, wherein, in a two-dimensional graph where an ordinate axis represents a current, and an abscissa axis represents a voltage, the electroluminescence display apparatus is configured to determine an emission current flowing in the light emitting device at an intersection point at which a first current-voltage curve representing an operation of the driving element intersects with a second current-voltage curve representing an operation of the light emitting device, and even when a threshold voltage of the light emitting device is shifted due to a temperature and degradation, the first current-voltage curve maintains a predetermined form without being changed.

* * * * *